United States Patent [19]

D'Arcy

[11] 4,432,154

[45] Feb. 21, 1984

[54] PAGE MANIPULATION APPARATUS IN APPARATUS FOR AUTOMATICALLY TURNING PAGES

[75] Inventor: James A. D'Arcy, Laguna Beach, Calif.

[73] Assignee: Dejon Corporation, Long Beach, Calif.

[21] Appl. No.: 355,347

[22] Filed: Mar. 8, 1982

[51] Int. Cl.[3] ..... G09F 19/00

[52] U.S. Cl. ..... 40/531; 40/470

[58] Field of Search ..... 40/389, 470, 475, 531; 402/80 L

[56] References Cited

U.S. PATENT DOCUMENTS

| | | | |
|---|---|---|---|
| 1,069,122 | 8/1913 | Friedman | 40/475 |
| 1,692,337 | 11/1928 | Forbes | 248/445 |
| 2,317,001 | 4/1943 | Thys et al. | 248/445 |
| 2,359,895 | 10/1944 | Burton | 248/445 |
| 2,638,701 | 5/1953 | Dahlgren | 248/445 |
| 2,677,510 | 5/1954 | Osborne | 242/85.1 |
| 2,755,580 | 7/1956 | Justice | 40/531 |
| 2,791,847 | 5/1957 | Hagman | 40/531 |
| 2,885,806 | 5/1959 | Storm, Jr. et al. | 40/531 |
| 3,343,776 | 9/1967 | Wieszeck | 248/441 R |
| 3,484,970 | 12/1969 | Berlinsky et al. | 40/531 |
| 3,570,154 | 3/1971 | Cosenza | 40/475 |
| 4,031,644 | 6/1977 | Rogers | 40/470 |
| 4,102,071 | 7/1978 | D'Arcy | 40/531 |
| 4,121,361 | 10/1978 | D'Arcy | 40/470 |

FOREIGN PATENT DOCUMENTS

| | | |
|---|---|---|
| 1076511 | 7/1967 | United Kingdom . |

*Primary Examiner*—Gene Mancene
*Assistant Examiner*—Cary E. Stone
*Attorney, Agent, or Firm*—William W. Haefliger

[57] ABSTRACT

Apparatus for sequentially turning pages of a book or the like includes a turned page holder having a first part movable up and down, and a second part carried by the first part that swings over the turning pages during holder displacement between up and down position.

17 Claims, 8 Drawing Figures

PAGE MANIPULATION APPARATUS IN APPARATUS FOR AUTOMATICALLY TURNING PAGES

BACKGROUND OF THE INVENTION

This invention relates generally to apparatus for automatically turning pages of a book or the like; more particularly it concerns simple, compact, reliable apparatus which requires only minimal effort of a user or reader to effect the page turning operation.

There is need for devices of the type described herein, allowing persons who are partially immobilized, disabled or bedridden to turn pages of a book, at will, merely by operation of a switch. Prior devices either did not have this capability or they were bulky, heavy, or insufficiently reliable particularly when inverted to cause the book to face downwardly toward a bedridden patient. Examples of prior devices are found in U.S. Pat. Nos. 2,638,701; 1,692,337; 2,359,895; 2,677,510; 2,317,001; and 3,343,776. Such prior devices were not constructed for turning pages of so-called "paper back books" whose rough textured pages are especially difficult to handle, mechanically. My U.S. Pat. No. 4,121,361 discloses unusually advantageous improved apparatus for turning pages.

SUMMARY OF THE INVENTION

It is a major object of the invention to provide yet further (improved and unusual) advantageous, reliable, lightweight, compact and efficient apparatus for turning pages of a book or the like, the apparatus being automatic and characterized as overcoming problems associated with prior devices.

It is another object of the invention to provide automatic page turning apparatus which may be inverted to face downwardly, without disruption of its functioning.

It is a further object of the invention to provide apparatus capable of efficiently and automatically turning pages of a paper backed book.

It is a further object of the invention to provide apparatus that includes:

(a) structure forming a zone to receive said pages, (b) a turned page holder located proximate said zone to hold down a turned page, and (c) actuator driven means operatively connected with the holder for displacing same between down and up positions, the down position characterized in that the holder is maintained in clamping engagement with an edge portion of a turned page while a page to be turned is being displaced in the turn direction, said up position characterized in that the holder is temporarily raised to allow the turning page to be displaced downwardly onto a previously turned page, after which the holder returns to said down position, (d) the improvement comprising said holder including a first part movable up and down, and a second part carried by the first part for swinging movement relative thereto during holder displacement between said up and down positions.

That holder incorporates unusually advantageous structure, mode of operation, and results, and combinations thereof, as will be seen. Typically, the two parts comprise first and second arms, respectively, the two arms being controllably swingable about different axes which relatively vary during page turning and holder movement, to effect usually advantageous sweeping and clamp-down of a page being turned, so that the page is efficiently displaced downwardly in precise registration with a stack of pages already turned.

A further object of the invention is to combine the holder and its operation with other devices operable to effect and facilitate page turning, (i.e. page "pushing", "flipping", and "hold down") as will be seen.

These and other objects and advantages of the invention, as well as the details of an illustrative embodiment, will be more fully understood from the following specification and drawings, in which:

DRAWING DESCRIPTION

GENERAL ORGANIZATION

Figure 1:
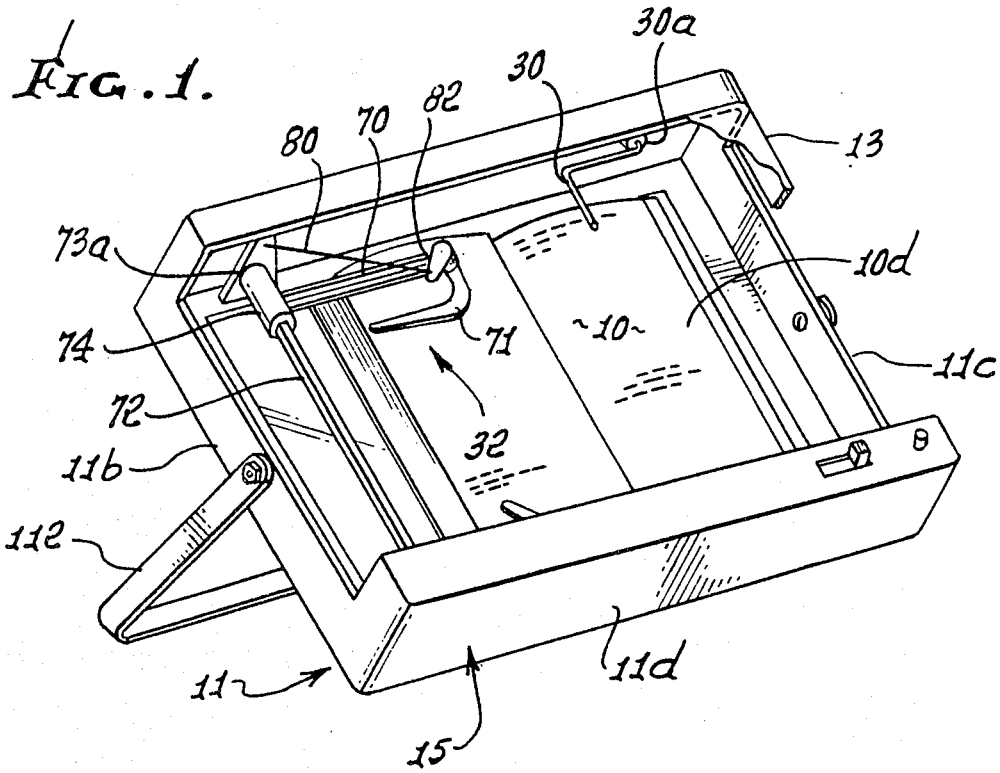
FIG. 1 is a perspective showing of page turning apparatus embodying the invention.
Figure 2:
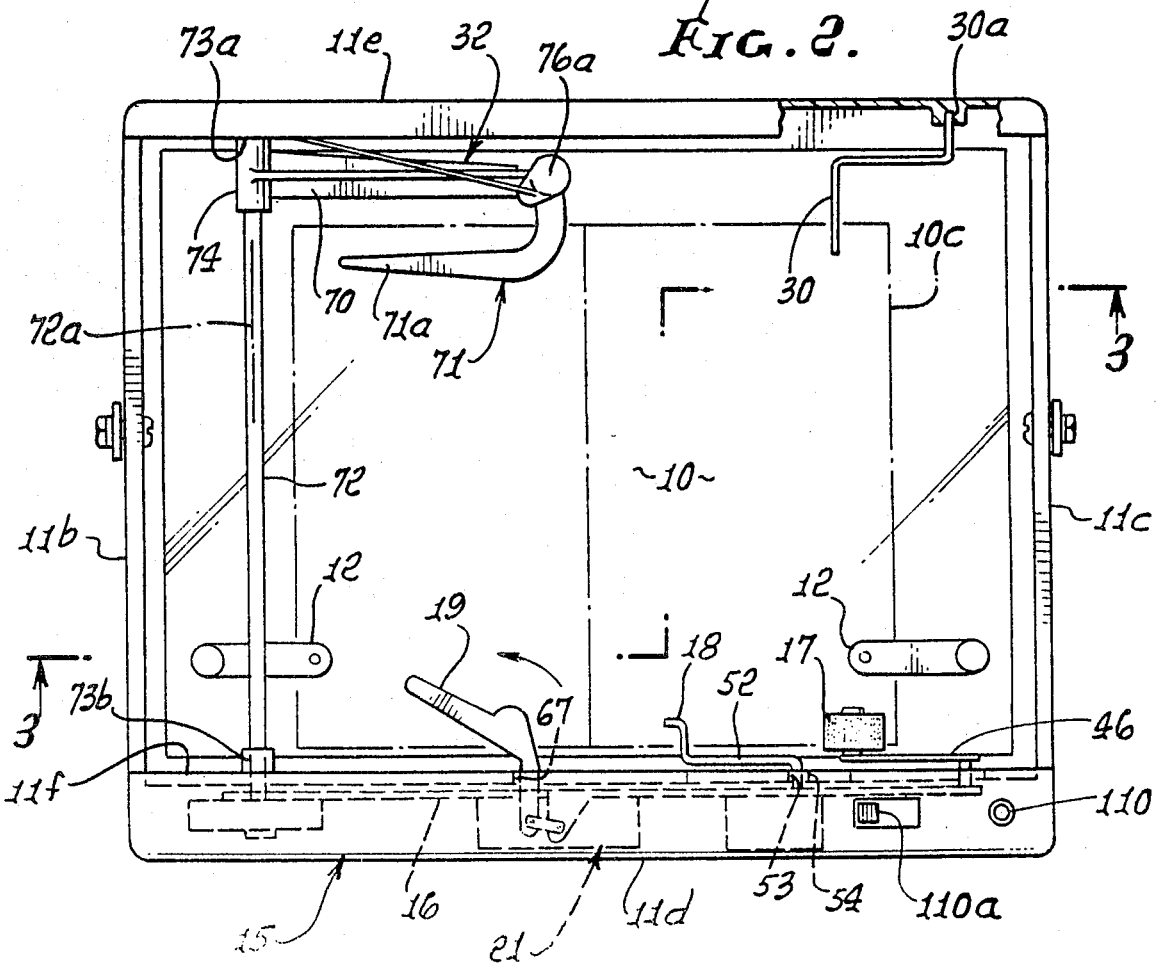
FIG. 2 is a top plan view of the FIG. 1 apparatus.
Figure 3:
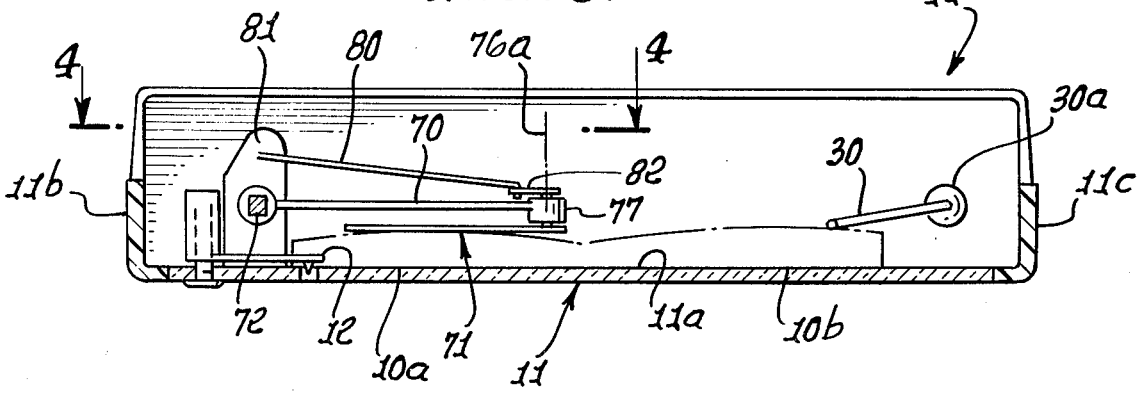
FIG. 3 is an enlarged section taken on lines 3—3 of FIG. 2.

In the drawings, structure is shown forming a zone to receive pages of a book or the like. As an example, a paper-back book 10 is shown in FIGS. 1–3 in open condition, with its front and back covers 10*a* and 10*b* laid flatly against the bottom wall 11*a* of the receptacle 11, which wall may comprise a transparent plate. That wall may carry retainer tabs 12 located to overlie and retain the covers to thereby position the book, the outer rectangular boundary of which is indicated by broken lines 10*c* in FIG. 2. The receptacle 11 also includes end walls 11*b* and 11*c*, and side walls 11*d* and 11*e*. A cover 13 for the receptacle may be provided and may have a glass or clear plastic transparent top wall allowing viewing through same. A light may also be provided to illuminate the interior of the receptacle.

A longitudinal upright partition 11*f* extends within the receptacle to separate the book zone from a longitudinally elongated actuator zone 15. The receptacle may be supported by a bracket arm 112, so as to be controllably and adjustably oriented relative to a reader. For example, the reader may be lying on his back, as on a hospital bed, and the receptacle may be fully or partially inverted, so that the open pages of the book 10 face downwardly toward the reader. As will appear, the book is not dislocated during such inversions.

Actuator driven means is typically carried by the receptacle structure, as for example within the narrow side zone or compartment 15, in order to provide a compact assembly. Such means may with unusual advantage include a longitudinally elongated member 16, movable or reciprocable longitudinally endwise, so that components operatively connected to that member are movable to effect page turning. See also U.S. Pat. No. 4,121,361.

A pusher, or rotor in the form of a roller, is indicated at 17 and is operatively connected to the actuator driven means to frictionally push an exposed page 10*d* in a turn direction (to the left in FIGS. 1, 2 and 6–8) and slidably over the next below page, and resulting in upward bulging of that upper page as indicated at 10*d*'. Such motion of the pusher occurs in response to leftward displacement of the member 16. The page is pushed out from beneath a retainer arm 30 frictionally but yieldably retained downwardly against the page. See friction bearing 30*a*.

A clamping foot indicated at 18 is located to clamp down on page 10*d* leftwardly of the roller to facilitate initial development of the bulge. This is important particularly in the case of a "paper back" book, whose pages frictionally resist relative sliding. The foot is also operatively connected to the actuator driven means, as for example to member 16, to lift and thereby release that page for continued upward bulging turning in response to left displacement of member 16.

Figure 6:
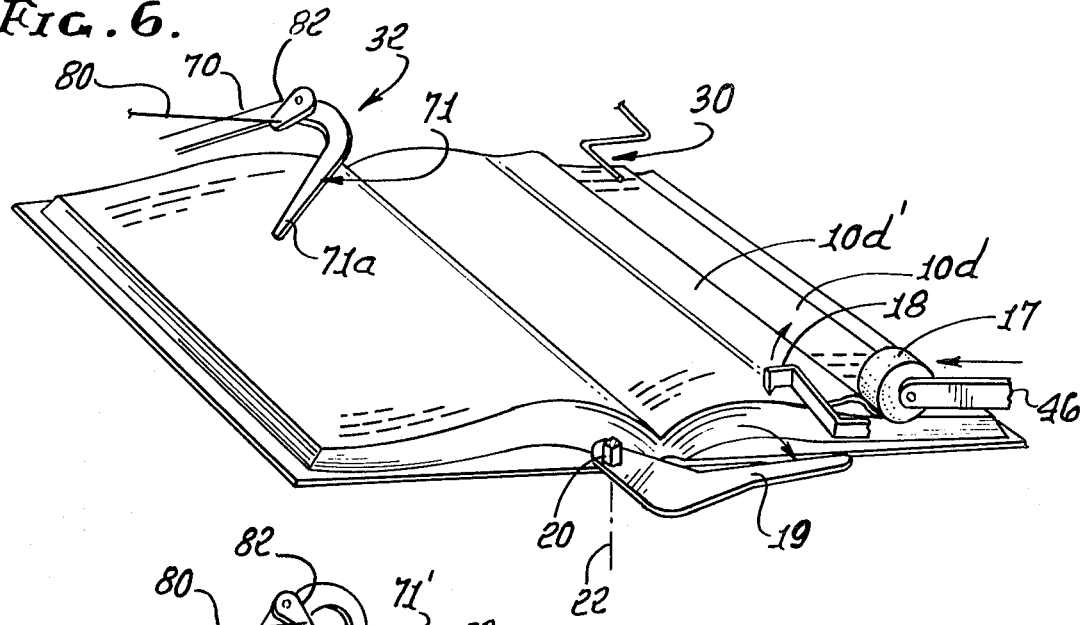
FIG. 6 is a perspective showing of the FIGS. 1–5 apparatus in combination with a book, and at the initiation of page turning.

A first flipper arm 19 spaced leftwardly of the foot is also operatively connected to the actuator driven means, as for example to the output shaft 20 of an actuator (indicated at 21 in FIG. 2). The arm 19 is swingable about the upright axis 22 of shaft 20 and in a counterclockwise direction in FIG. 7 to move beneath the extreme upward bulge and to flip the page over (to the left) toward the stack 10*e* of already turned pages. Arm 19 is at an elevation to ride over the turned page, as seen in FIG. 8. This occurs during rightward displacement of the member 16. Leftward movement of the member 16 swings the arm to retracted position as seen in FIG. 6.

Finally, a turned page holder 32 is operatively coupled to the actuator driven means to hold down turned pages as during initial displacement of the member 16 to the left. It temporarily moves out (up in FIGS. 6 and 7) of the path of a page being turned to allow completion of such turning, after which the holder moves back down to clamp the turned page, all in response to reciprocation of the member 16 or other actuator as may be provided. In practice, the page may be allowed to momentarily contact the top of the holder, after which the latter moves to allow completion of page turning.

DETAILED DESCRIPTION

Figure 4:
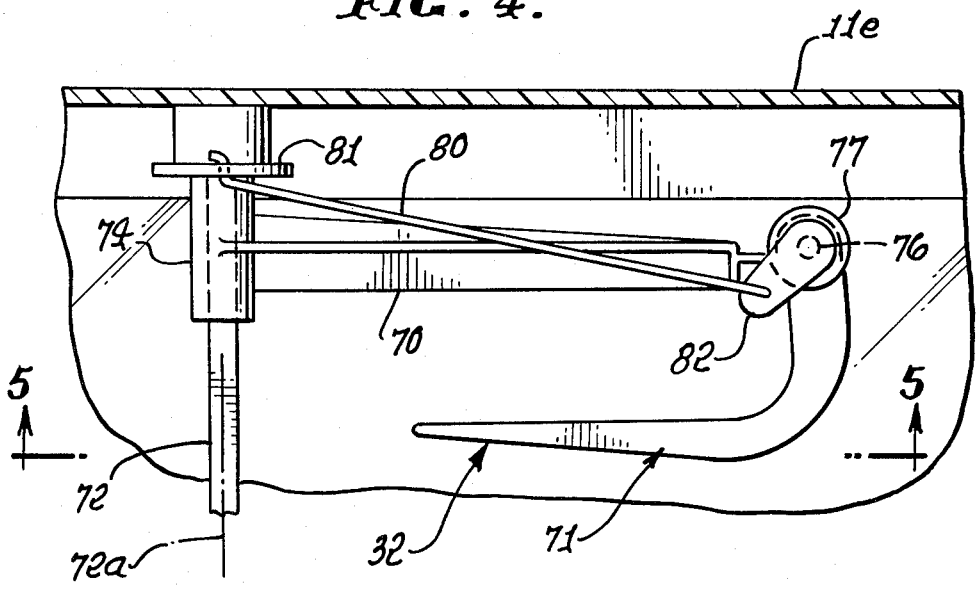
FIG. 4 is an enlarged plan view taken in section on lines 4—4 of FIG. 3.

The pusher roller 17 is shown as carried on an arm 46 urged counterclockwise by a torsion spring (see U.S. Pat. No. 4,121,361). Therefore, as the member 16 is urged to the left in FIGS. 3 and 4 by a suitable actuator as shown at 21, the pusher roller is carried with it, and the frictional surface of the roller frictionally pushes the top page of the stack to the left and toward the foot 18, resulting in creation of the bulge as described. The roller may be constructed to have a one-way clutch allowing one-way rotation only, i.e. to rotate clockwise in FIG. 6 (but not counterclockwise, so that it does not rotate during shifting to the left to create the bulge) however, on the return stroke of member 16 to the right, the roller rotates over the top of the next exposed page. Alternatively, the roller may be driven in place to rotate and frictionally displace the page as described, and subsequently to rotate in the opposite direction to hold the next page stretched out.

Extending the description to FIG. 2 the foot 18 is shown as carried at one end of up-down carrier arm 52 projecting through an opening 53 in wall 11*f*. The opposite end of the arm is pivoted at 54 to allow the foot to move up and down, in a lateral vertical plane. The surface of the foot may carry a friction material, to frictionally retain the top page in position beneath the foot during page bulge development. As the member 16 is advanced to the left the arm is moved upwardly allowing the bulged page to pass leftwardly beneath the raised foot. A torsion spring may be used to bias the arm downwardly in FIG. 6 to hold the foot 18 down on the stack 10*g* of pages to be turned.

The first flipper arm 19 is coupled to the actuator driven means, as for example actuator 21 so as to be rotated to FIG. 6 position as member 16 moves leftwardly. In that position, the arm 19 is outside the path of upward turn-over of the page 10*d*; however, on the subsequent return stroke of member 16 to the right the arm 19 swings counterclockwise, flipping the turning page 10*d* down toward the stack 10*e*. See the sequence illustrated in FIGS. 6–8. The foot 18 is also dropped onto the next page 10*g* to be turned, as the member 16 strokes to the right. Arm 19 projects through a slot 67 in partition 11*f*.

A switch to control operation of the motor (to cycle part 16 once) is indicated at 110 in FIG. 2. Switch 110*a* pre-sets the circuitry in "READY" or "OFF" state.

Figure 5:
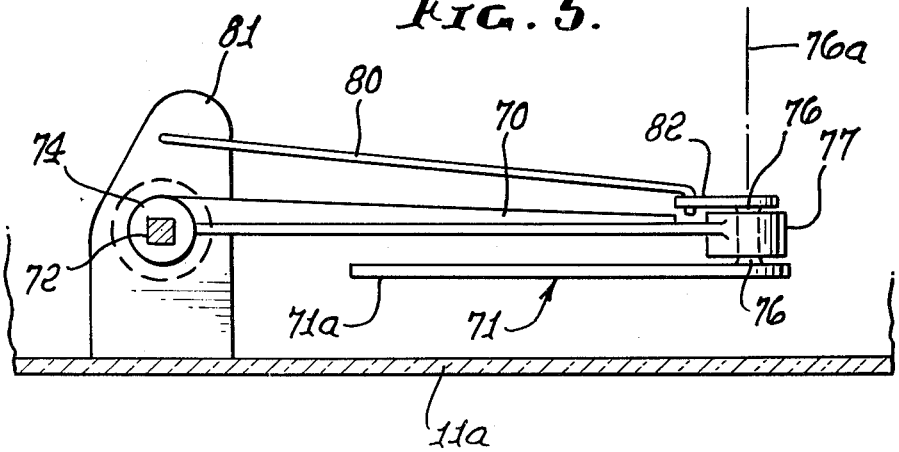
FIG. 5 is a side elevation taken on lines 5—5 of FIG. 4.
Figure 7:
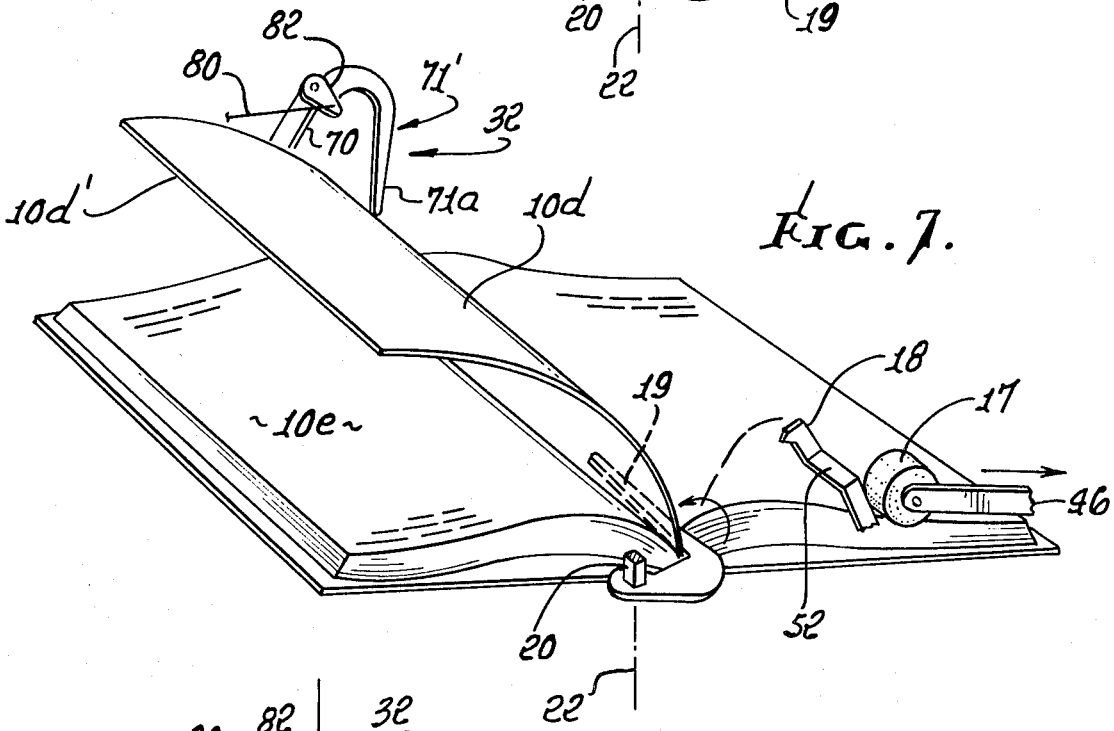
FIG. 7 is a view like FIG. 6, showing a position of the mechanism during page turning.
Figure 8:
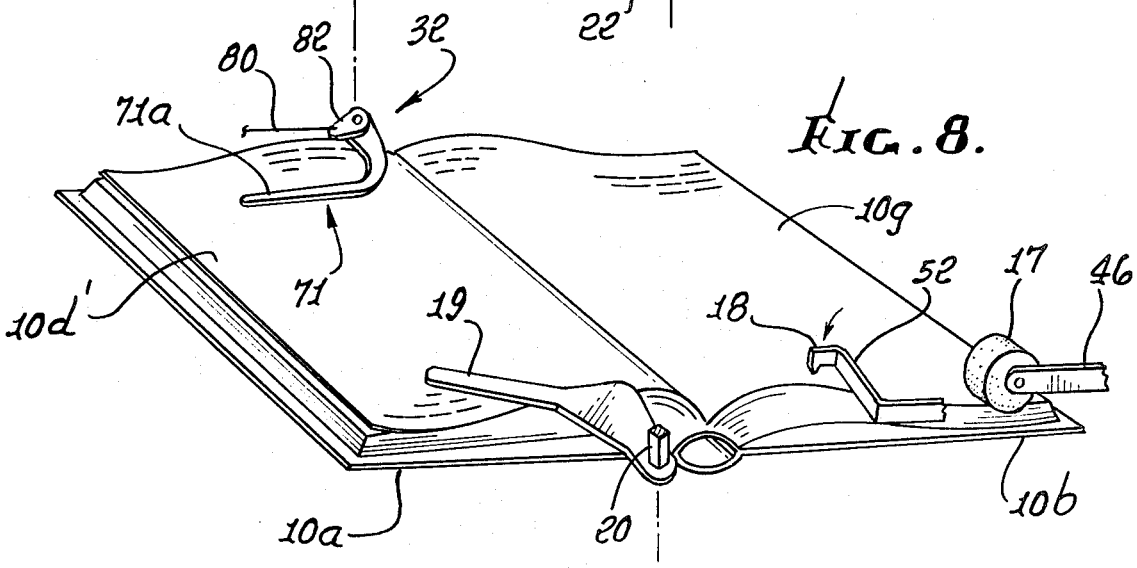
FIG. 8 is a view like FIG. 6 showing the position of the mechanism at the completion of page turning.

The turned page holder includes a first part, such as arm 70, which is movable up and down, and a second part, such as arm 71 for example, which is carried by the first part for swinging movement relative thereto during holder 32 displacement between up and down positions (see FIGS. 6–8, for example). In this regard, the second part or arm 71 has a collapsed position relative to part 71 in holder "down" position (see FIGS. 1–5 and 8), wherein the L-shaped arm 71 has elongated extent 71*a* extending generally parallel to arm 70, and back toward a shaft 72, overlying the after marging of a book. In this regard, the first arm is attached at 74 to shaft 72, and is therefore pivoted about a first axis 72*a*, which is the axis of shaft 72; and the second arm 71 is pivoted about a second axis 76*a* at the end of arm 70. To this end, the arm 71 may be carried by a shaft 76 received in journal 77 integral with arm 70. See FIG. 5. The opposite ends of shaft 72 are journaled at 73*a* and 73*b*.

Mechanism is provided to effect swinging of the second arm 71 in response to pivoting of the first arm 70 with shaft 72, and between collapsed position as referred to, and extended position 71' as seen for example in FIG. 7. In that raised position, extent 71*a* extends generally normal to arm 70, and parallel to the page 10*d* being turned, but sufficiently out of the way or path of page turning so as not to interfere with such turning. As the arm 71 returns back down from extended position (FIG. 7) to collapsed position (FIG. 8), it sweeps over the top 10*d*' of the page 10*d* being turned and urges it downwardly to assure its registration with a previously turned page during completion of page turning.

As illustrated, the referenced mechanism includes a link 80 (made of wire, for example) connected between structure 81 (above and eccentrically proximate connection 74) and a crank 82 integral with shaft 76. Accordingly, and with reference to FIG. 4, as arm 70 is raised, link 80 pivots crank 82 and arm 71 counterclockwise, whereas when arm 70 is lowered, link 80 pivots crank 82 and arm 71 clockwise, about axis 76*a*. Note in FIGS. 6 and 7 that since axis 76*a* is variably tilted, the arm 71 is swung in variably tilted planes which conform to the functioning of page turning and sweeping of arm 71 over the page as it is pushed downwardly by arm 71 toward the page stack 10*e*.

Retainer 30 is generally Z-shaped, and is lightly frictionally biased in carrier 30*a* to page hold-down position, as shown. The user may initially set the retainer 30 in that position, and it remains there during operation of the apparatus. Its narrow (wire) width does not interfere with page turning or reading.

I claim:

1. In apparatus for sequentially turning pages of a book or the like, the combination comprising (a) structure forming a zone to receive said pages, (b) a turned page holder located proximate said zone to hold down a turned page, and (c) actuator driven means operatively connected with the holder for displacing same between down and up positions, the down position characterized in that the holder is maintained in clamping engagement with an edge portion of a turned page while a page to be turned is being displaced in the turn direction, said up position characterized in that the holder is temporarily raised to allow the turning page to be displaced downwardly onto a previously turned page, after which the holder returns to said down position, (d) the improvement comprising said holder including a first part movable up and down, and a second part carried by the first part for swinging movement relative thereto during holder displacement between said up and down positions.

2. The apparatus of claim 1 wherein said second part has collapsed position relative to the first part in holder down position, and an extended position relative to the first part in holder up position.

3. The apparatus of claim 2 wherein said first part comprises a first arm which is pivoted about a first axis during said holder displacement between up and down positions and said second part comprises a second arm which is swingable about a second axis during said holder displacement.

4. The apparatus of claim 3 wherein said second arm in collapsed position projects generally parallel to said first arm.

5. The apparatus of claim 4 wherein said second arm in extended position projects generally normal to said first arm.

6. The apparatus of either one of claims 4 or 5 wherein said first arm remains outside said page zone, whereas said second arm projects over said page zone during said holder displacement.

7. The apparatus of claim 3 including mechanism to effect said swinging of the second arm in response to said pivoting of the first arm.

8. The apparatus of claim 7 wherein said mechanism includes a link connected between said structure and a crank associated with the second arm.

9. The apparatus of claim 8 including a transverse shaft mounting the first arm for pivoting, the link connected with said structure in eccentric relation to the axis defined by said transverse shaft.

10. The combination of claim 1 including (e) a pusher located proximate said zone to engage an exposed page to be turned, (f) an actuator and actuator driven means operatively connected with the pusher for bodily displacing same generally linearly and with back and forth reciprocation in the direction of page turning between a first position and a range of subsequent advanced positions, said first position characterized in that the pusher is urged against the exposed page to be turned, and said range of subsequent positions characterized in that the pusher is bodily displaced to frictionally push the exposed page in a turn direction causing its sliding against another page and resulting in progressive upward bulging of that page while sliding over the surface of the next below page beneath the pusher.

11. The combination of one of claims 1 or 10 including a retainer arm engaging the exposed page to be turned.

12. The combination of claim 11 wherein said retainer arm is pivoted and lightly frictionally retained against pivoting.

13. The combination of claim 12 wherein said retainer arm has generally Z shaped configuration.

14. The combination of claim 10 wherein the pusher comprises a rotor, and including structure yieldably urging the rotor toward the exposed page to be turned.

15. The combination of claim 1 including said pages, and means to hold said pages in said zone.

16. The combination of claim 1 including (e) a clamping foot located proximate said zone to engage an exposed page to be turned, and (f) actuator driven means operatively connected with the foot for displacing same between a down position and a raised position, said down position characterized in that the foot is maintained in clamping engagement with a localized medial zone of the page as a free end portion of the page is urged in a turn direction, whereby said free end portion progressively bulges upwardly, said raised position characterized in that said foot is temporarily raised to free the bulged page to be bodily displaced relatively under the raised foot and in said turn direction.

17. The combination of claim 1 including (e) a first flipper arm proximate said zone to engage an exposed page to be turned, and (f) actuator driven means operatively connected with the flipper arm for bodily displacing same along a generally linear path and with back and forth reciprocation between retracted and advanced positions, said advanced position characterized in that the arm is temporarily maintained overlying an already turned page, said arm being retracted while a page to be turned is urged in a turn direction and progressively bulged upwardly, said path of arm displacement between retracted and advanced positions characterized in that the arm is brought under said bulge and into engagement with the page to be turned and said arm then flips said page over and beneath the arm as the arm reciprocates to move in a direction opposite to page turning, and toward retracted position.

* * * * *